United States Patent [19]

Sternberg et al.

[11] Patent Number: 4,513,701

[45] Date of Patent: Apr. 30, 1985

[54] VALVE FOR AN INTERNAL COMBUSTION ENGINE

[75] Inventors: Rudolf Sternberg, Oberboihingen; Martin Schnapper, Stuttgart, both of Fed. Rep. of Germany

[73] Assignee: Daimler-Benz Aktiengesellschaft, Stuttgart, Fed. Rep. of Germany

[21] Appl. No.: 429,681

[22] Filed: Sep. 30, 1982

[30] Foreign Application Priority Data

Oct. 28, 1981 [DE] Fed. Rep. of Germany ..... 3142670

[51] Int. Cl.[3] ..... F01L 3/10

[52] U.S. Cl. ..... 123/188 AA; 29/156.7 R; 251/337

[58] Field of Search ..... 123/188 A, 188 AA; 29/156.7 R; 251/337

[56] References Cited

U.S. PATENT DOCUMENTS

| | | | |
|---|---|---|---|
| 2,450,803 | 10/1948 | Johnson | 123/188 AA |
| 2,745,777 | 5/1956 | Clarke | 123/188 AA |
| 3,033,518 | 5/1962 | Sampietro | 251/337 |
| 3,710,773 | 1/1973 | Piech et al. | 123/188 AA |
| 4,073,474 | 2/1978 | Hashimoto et al. | 123/188 AA |

FOREIGN PATENT DOCUMENTS

| | | | |
|---|---|---|---|
| 1921806 | 11/1970 | Fed. Rep. of Germany . | |
| 2240572 | 2/1974 | Fed. Rep. of Germany | 123/188 A |
| 2827271 | 1/1979 | Fed. Rep. of Germany R | 29/156.7 |
| 44122 | 4/1979 | Japan | 123/188 AA |
| 338055 | 6/1959 | Switzerland | 123/188 A |

OTHER PUBLICATIONS

"Nitriding the Austenite Steels Improves Wear Resistance", I. A. Binder, American Machinist, Sep. 14, 1944, pp. 102–103.

*Primary Examiner*—Ira S. Lazarus
*Assistant Examiner*—R. S. Bailey
*Attorney, Agent, or Firm*—Walter W. Burns, Jr.

[57] ABSTRACT

A valve of an internal combustion engine in which for purposes of increasing the strength within the area of the annular groove for the conical pieces retaining the spring plate for the valve springs, the corners of the annular groove are rounded-off with a relatively small radius which passes over into the cylindrical part of the annular groove by way of a larger radius; the upper portion of the valve stem is provided with an outer layer which is induction-hardened and which extends up to within the clamping area of the conical pieces.

1 Claim, 3 Drawing Figures

FIG. 1
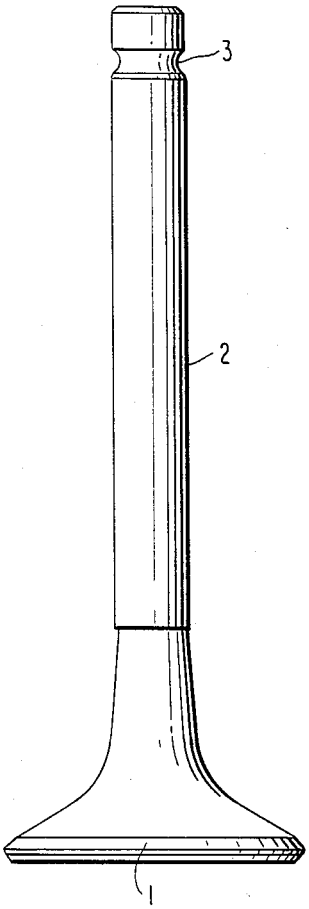
FIG. 2
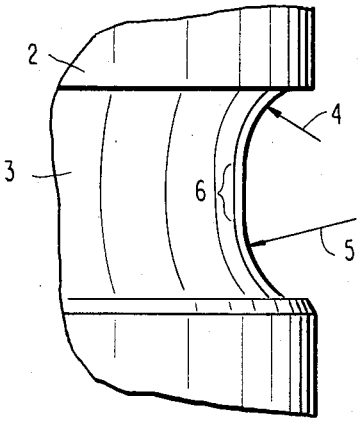
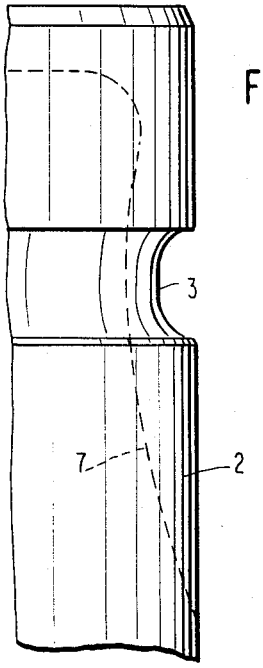
FIG. 3

VALVE FOR AN INTERNAL COMBUSTION ENGINE

The present invention relates to a valve for an internal combustion engine, especially for an internal combustion engine for the drive of commercial vehicles, in which an annular groove with an essentially rectangular cross section in a plane which includes the axis of the valve and rounded-off corners is provided at the end of the valve stem, remote from valve disk into which engage the conical pieces retaining the spring plate for the valve springs.

The present invention is concerned with the task of increasing, in connection with valves of this type, as are known, for example, from the German Offenlegungsschrift 19 21 806 and the U.S. Pat. No. 2,065,794, the strength of the valve stem end within the area of the annular groove and therewith within the clamping area of the conical pieces. As a solution to the underlying problems, the present invention provides that the corners of the annular groove be rounded off with a small radius and this small radius effects a transition into a cylindrical part of the annular groove thence to an adjoining larger radius. The larger radius of the rounded-off part may thereby amount to three times the smaller radius.

As tests have indicated, the strength of a valve is considerably increased by means of the construction of the annular groove in accordance with the present invention which requires low cost. A not-insignificant contribution is supplied to that end by an inductive-outer layer hardening which, according to a further feature of the present invention, extends into the clamping area of the conical pieces from the end of the valve stem remote from a relative disk to a location between the annular groove and the valve disk.

These and other objects, features and advantages of the present invention will become more apparent from the following description when taken in connection with the accompanying drawing which shows, for purposes of illustration only, one embodiment in accordance with the present invention, and wherein:

FIG. 1 is an elevational view, on an enlarged scale, of a valve in accordance with the present invention;

FIG. 2 is a partial elevational view, on a further enlarged scale, of the valve stem of a valve in accordance with the present invention within the area of the annular groove; and FIG. 3 is an elevational view of the end of the valve stem of the valve remote from a valve disk in accordance with the present invention.

Referring now to the drawing wherein like reference numerals are used throughout the various views to designate like parts, according to FIG. 1, the valve essentially consisting of a valve disk 1 and of a valve stem 2 includes in the upper area of the valve stem 2 an annular groove 3 of essentially rectangular cross section with rounded-off corners. Correspondingly constructed projections provided at conventional conical pieces (not shown) engage in the annular groove 3, which in their turn clampingly hold the spring plate for the valve springs (not shown).

As can be seen more clearly from FIG. 2, the corners of the annular groove 3 are rounded off with a small radius 4 which effects a transition into the cylindrical part 6 of the annular groove 3 and thence by way of an adjoining larger radius 5. It has thereby proved as particularly advantageous to keep the larger radius 5 about three times as large as the smaller radius 4.

The part of the valve stem 2 remote from the valve disk is provided with an inductive-outer layer hardening up to the clamping area of the conical pieces engaging into the annular groove 3, in such a manner that a hardening depth in the rim zone or outer layer results in the material of the valve stem 2 according to FIG. 3 which extends according to the dash line (FIG. 3) from the upper end of the valve stem 1 well beyond the annular groove.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A valve for an internal combustion engine comprising a valve stem provided near an end thereof remote from a valve disk with an annular groove having a rectangular cross section and rounded-off innermost corners, characterized in that the innermost corners of the annular groove are rounded-off with a relatively small radius at a first innermost corner and said small radius effects a transition with a cylindrical portion of the annular groove thence to an adjoining larger radius at a second innermost corner wherein the larger radius is about three times as large as the smaller radius, the valve stem has an inductively hardened outer layer which extends from the end of the valve stem remote from the valve disk and terminating at a location between the annular groove and said valve disk wherein the valve stem has a longitudinal axis and the hardened outer layer in the area of the annular groove extends radially toward the axis to a depth greater than the groove to provide a hardened surface for and a hardened layer below the groove.

* * * * *